US006330269B1

(12) United States Patent
Manasek et al.

(10) Patent No.: US 6,330,269 B1
(45) Date of Patent: Dec. 11, 2001

(54) HEAT EXCHANGE PIPE WITH EXTRUDED FINS

(75) Inventors: Richard J. Manasek; David P. Kincheloe, both of Greenwood, IN (US)

(73) Assignee: Amerifab, Inc., Indianapolis, IN (US)

( * ) Notice: Subject to any disclaimer, the term of this patent is extended or adjusted under 35 U.S.C. 154(b) by 0 days.

(21) Appl. No.: 09/697,272

(22) Filed: Oct. 26, 2000

Related U.S. Application Data

(60) Provisional application No. 60/184,147, filed on Feb. 22, 2000.

(51) Int. Cl.[7] ..... F27D 1/12

(52) U.S. Cl. ..... 373/76; 373/71; 373/75

(58) Field of Search ..... 373/71, 72, 75, 373/76; 266/193, 194; 432/233

(56) References Cited

U.S. PATENT DOCUMENTS

| | | | |
|---|---|---|---|
| 1,774,150 | 8/1930 | Murray . | |
| 1,844,407 | 2/1932 | Murray . | |
| 2,239,662 | 4/1941 | Bailey . | |
| 3,294,162 | 12/1966 | Loehlein et al. . | |
| 4,097,679 | 6/1978 | Fukumoto et al. . | |
| 4,122,295 | 10/1978 | Nanjyo et al. . | |
| 4,135,575 | 1/1979 | Gersch . | |
| 4,221,922 | 9/1980 | Okimune . | |
| 4,351,055 | 9/1982 | Bick et al. . | |
| 4,455,017 | 6/1984 | Wunsche . | |
| 4,458,351 | 7/1984 | Richards . | |
| 4,559,011 * | 12/1985 | Gritsuk et al. | 373/76 |

* cited by examiner

*Primary Examiner*—Tu Ba Hoang

(57) ABSTRACT

An apparatus and method for cooling the interior wall of an electric arc furnace. The device is an extruded heavy-walled pipe having a base and a fin or plurality of fins. Such pipes are attached to a plate in serpentine fashion and hung on the inside wall of the electric arc furnace above the hearth, thereby forming a cooling surface between the interior and the furnace wall. The fins are sized and arranged to retain splattered slag. The slags solidifies on the pipes, forming an insulation barrier between the molten iron material and the cooling pipes and, consequently, the wall of the furnace.

19 Claims, 3 Drawing Sheets

Fig.5
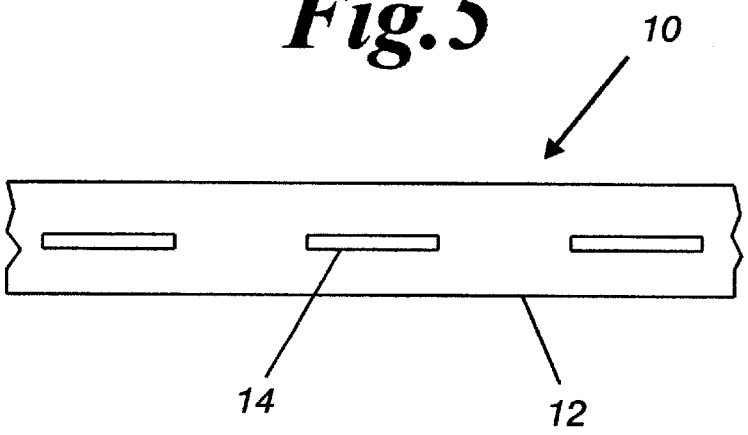
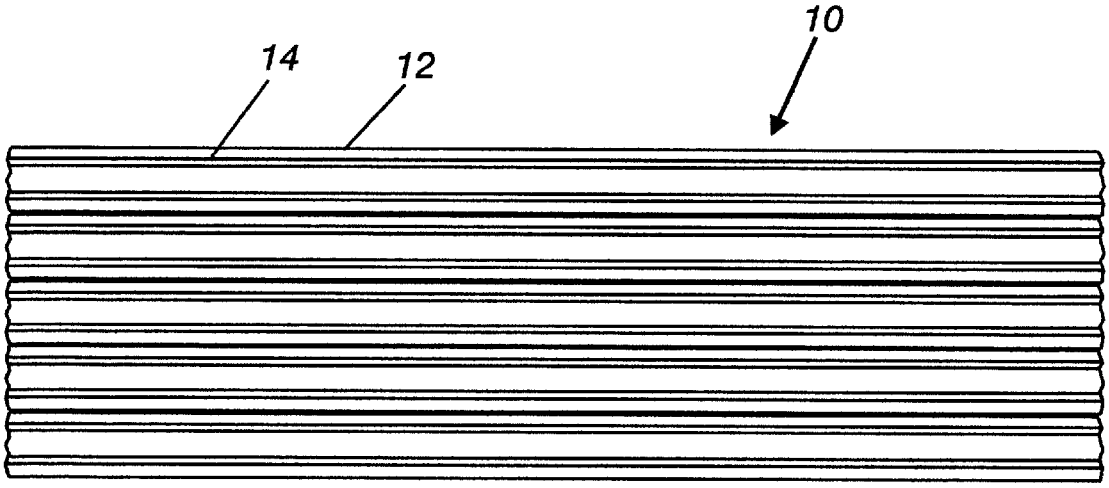
Fig.6

HEAT EXCHANGE PIPE WITH EXTRUDED FINS

CROSS REFERENCE TO RELATED APPLICATION

This application claims the benefit of U.S. Provisional application No. 60/184,147, filed Feb. 22, 2000.

FIELD OF THE INVENTION

This invention relates to apparatus for metallurgical processing, particularly steelmaking. More particularly, the invention relates to a cooling apparatus for a metallurgical furnace. More specifically, the invention relates to a type of pipe used in a cooling apparatus for an electric arc steelmaking furnace, and the apparatus which incorporates the pipe therein.

BACKGROUND OF THE INVENTION

Steel is made by melting and refining iron and steel scrap in an electric arc furnace (EAF). Today, the EAF is considered by those skilled in the art of steel production to be the single most critical apparatus in a steel mill or foundry. Consequently, it is of vital importance that each EAF remain operational for as long as possible.

Structural damage caused during the charging process affects the operation of an EAF. Since scrap has a lower effective density than molten steel, the EAF must have sufficient volume to accommodate the scrap and still produce the desired amount of steel. As the steel melts it forms a hot metal bath in the hearth or smelting area in the lower portion of the furnace. As the volume of steel in the furnace is reduced, however, the free volume in the EAF increases. The portion of the furnace above the hearth or smelting area must be protected against the high internal temperatures of the furnace. The vessel wall, cover or roof, and duct work are particularly at risk from massive thermal, chemical, and mechanical stresses caused by charging and melting the steel. Such stresses greatly limit the operational life of the furnace.

Historically, the EAF was generally designed and fabricated as a welded steel structure which was protected against the high temperatures of the furnace by a refractory lining. In the late 1970's and early 1980's, the steel industry began to combat such stresses by replacing expensive refractory brick with water-cooled roof panels and water-cooled sidewall panels located in portions of the furnace vessel above the smelting area. Water-cooled panels have also been used to line furnace duct work. Existing water-cooled panels are made with various grades and types of plates and pipes.

Using water-cooled panels has reduced refractory costs and has also enabled steelmakers to operate each furnace for a greater number of heats. Furthermore, water-cooled equipment has enabled the furnaces to operate at increased levels of power. Consequently, production has increased and furnace availability has become increasingly important.

Although water-cooled panels last longer than brick refractory, the panels have problems with wear and are subject to damage. Critical breakdown of one or more of the panels commonly occurs within a few months of furnace operation. When such a breakdown occurs, the EAF must be taken out of production for unscheduled maintenance to repair the damaged water-cooled panels. Since molten steel is not being produced by the steel mill during downtime, opportunity losses of as much as five thousand dollars per minute for the production of certain types of steel can occur.

In addition to decreased production, unscheduled interruptions significantly increase operating and maintenance expenses.

To increase the life of water-cooled components, an effort is made to promote slag adherence to the surface of the water-cooled equipment. Adhered slag "freezes", that is solidifies, to the water-cooled equipment thereby forming a thermal and chemical barrier between the cooling equipment and interior of the furnace.

In prior art furnaces, slag is encouraged to stick to the cooling equipment by welding studs, fins or cup like members onto the surface of the equipment, or by using slag bars or other similar items. For example, U.S. Pat. No. 4,221,922 discloses a fin welded to a water-cooled panel. However, these typical methods cause stress risers, that is, the beginning of cracks at the molecular level within the material of the water-cooled pipes. The stress risers are caused by localized heating differentials or stress differentials during the manufacture of the pipes. As an electric arc furnace cycles, the components expand and contract, further breaking down the grain structure in the material of the pipes and broadening the stress risers, until a pipe in the cooling apparatus fails prematurely. Water leaking from a damaged pipe into the furnace can potentially lead to catastrophic reoxydation of hot metal in the furnace. Hence, a damaged cooling element must be timely replaced.

A need, therefore, exists for an improved water-cooled furnace panel apparatus which remains operable longer than existing comparable panels and continues to operate, despite some structural damage, until scheduled maintenance occurs.

OBJECTS OF THE INVENTION

The present invention is directed to a unitary heavy-walled, steel, iron, or ferrous alloy pipe for use in a cooling panel in an electric arc furnace. According to the present invention, the unitary pipe includes a tubular section, an elongate ridge, and a base section. The ridge and the base section are formed on the exterior surface of the tubular section and oppose each other.

According to another aspect of the present invention, the unitary pipe is formed by extrusion in which the mass of the half of the tubular section which includes the ridge is substantially equivalent to the mass of the other half of the tubular section which includes the base section.

According to a further aspect of the present invention, the pipe includes the following features individually or in combination: a plurality of elongate ridges, radially extending ridges, ridges of varying lengths and segmented ridges.

According to another aspect of the invention, a plurality of unitary pipes are interconnected in serpentine fashion and connected to a plate. The plate is connected to the interior of an electric arc furnace.

According to another aspect of the present invention, a method is provided for cooling the interior wall of an electric arc furnace. The method includes providing a cooling panel having a plurality of extruded unitary pipes. The pipes have a tubular section, an elongate ridge and a base section. The method further includes the steps of attaching the cooling panel to the interior of the electric arc furnace, retaining transient matter from the electric arc furnace on the elongate ridge and removing the tube assembly from the electric arc furnace.

SUMMARY OF THE INVENTION

The invention is a heavy-walled pipe for a cooling panel, the pipe having fin-like structures extending outwardly from the surface of the pipe. An array of the pipes are aligned along the inside wall of an electric-arc furnace above the hearth thereby forming a cooling surface between the interior and wall of the furnace.

The fins, extending from the pipe surface, tend to retain slag and spatter material from the iron/slag mixture in the electric-arc furnace during the refining of molten metal in the furnace. The slag is collected by the fins and retained against the pipe surface. The retained slag acts as an insulating barrier between the molten iron material and the cooling pipes as well as the wall which carries the pipes. This protects the wall and pipes from the extreme heat and chemically reactive conditions within a typical electric-arc furnace and, consequently, increases the longevity of the pipes and the cooling panel apparatus as a whole.

BRIEF DESCRIPTION OF THE DRAWINGS

The foregoing and other objects will become more readily apparent by referring to the following detailed description and the appended drawings in which:

FIG. 5 is a front view of the pipe having a segmented fin; and

FIG. 6 is a front view of an array of heat exchange pipes taken from the interior of a furnace.

DETAILED DESCRIPTION OF THE PREFERRED EMBODIMENT

Figure 1:
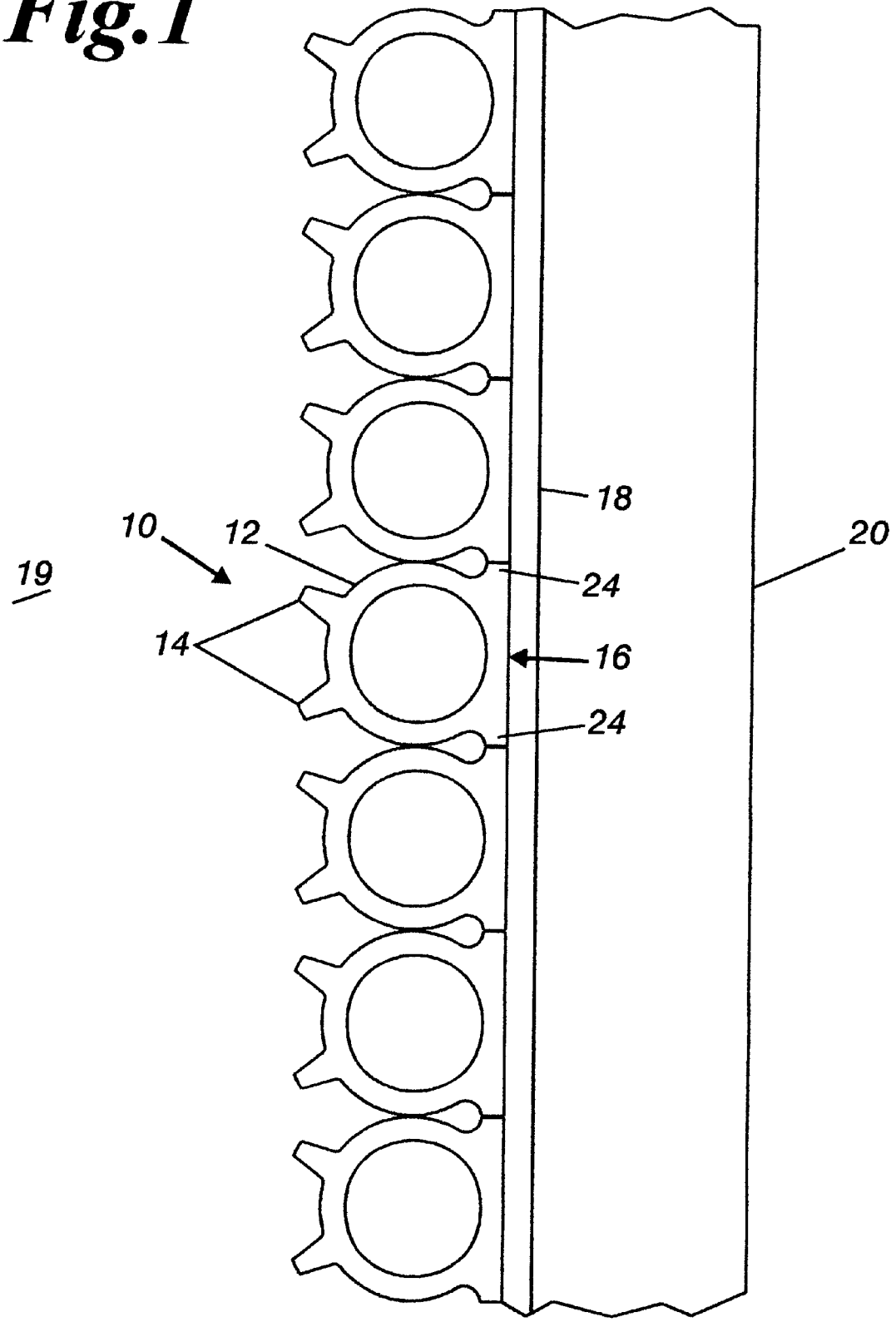
FIG. 1 is a cross-sectional view of an array of heat exchange pipes connected to a panel according to the present invention.

FIG. 1 shows an array of heat exchange pipes 10 having a tubular section 12, fins 14, and a base section 16 according to the present invention. The heat exchange pipe 10 is attached to a panel 18 and positioned between an interior and a wall of an electric arc furnace 19, 20. The heat exchange pipes 10 are used to cool the wall of the furnace 20 above the hearth. The fins 14 enhance the retention of slag onto the cooling pipes 10. Adhered slag freezes to the water-cooled pipes 10 thereby forming a chemical and thermal barrier between the cooling pipes 10 and the interior of the furnace 19.

Figure 3:
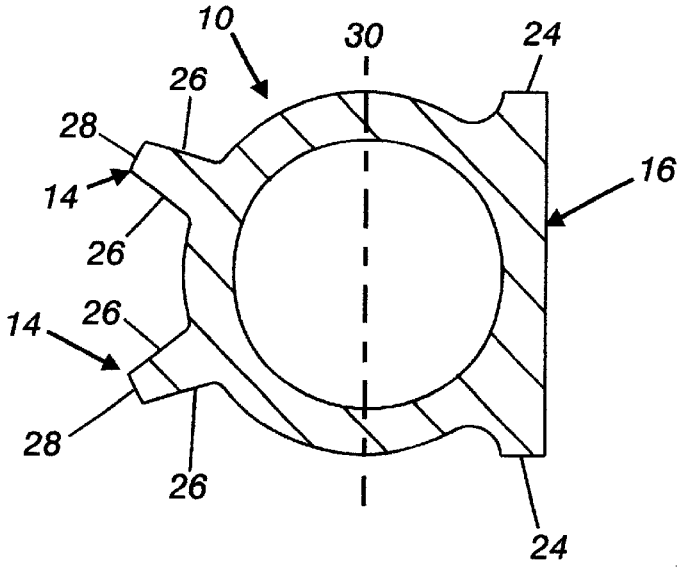
FIG. 3 is a cross-sectional view of the pipe having a plurality of fins.
Figure 2:
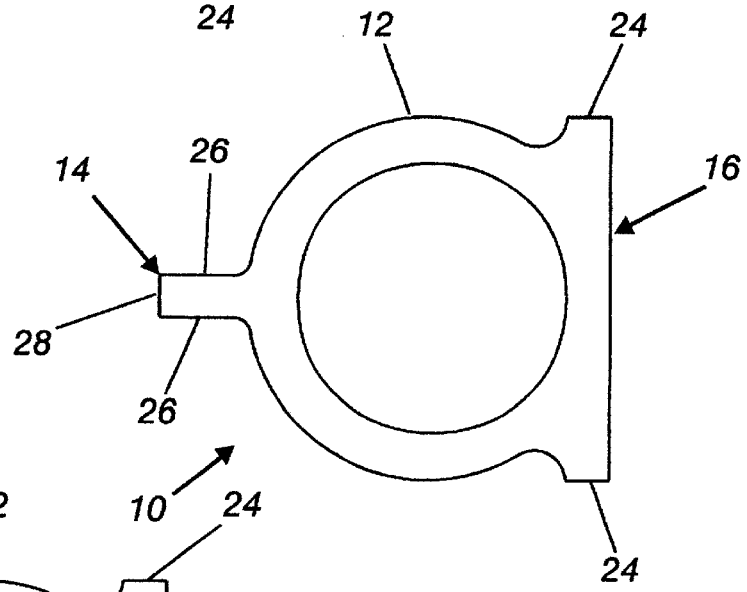
FIG. 2 is a cross-sectional view of the pipe having a single fin.
Figure 4:
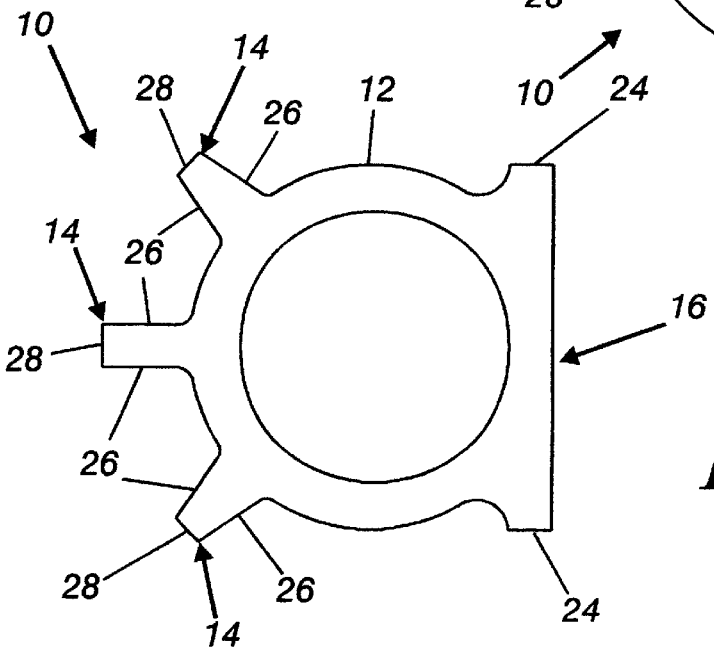
FIG. 4 is a cross-sectional view of the pipe having a plurality of fins of different cross-sectional area.

As shown in FIGS. 2, 3, and 4, the pipe 10 includes a tubular section 12, base section 16, and at least one fin 14. The tubular section 12 is hollow for conveying water or other cooling fluids. The base section 16 has a planer bottom 22 for connection to the panel 18. The base section 16 is provided with protruding ends 24 which preferably extend the distance of the outer diameter of the pipe 10 so to contact the base section 16 of an adjacent pipe 10. Alternatively, the protruding ends 24 can extend more than, or less than, the outer diameter of the pipe 10. The base section 16 additionally acts as a seal bar to ease the manufacturing process.

The fin 14 is positioned on the outer diameter of the tubular section 12 opposite of the base section 16. The pipe 10 can have one fin 14, as shown in FIG. 2, or a plurality of fins 14 as demonstrated by FIGS. 3 and 4. Furthermore, as illustrated by FIG. 4, which has a longer middle fin and shorter side fins, fins 14 of the same pipe 10 need not be coextensively sized or cross-sectionally shaped.

In each embodiment, the fin 14 is elongate, extending along the length of the tubular section 12 and outwardly projecting from the exterior surface of the tubular section 12. The fin 14 outwardly projects perpendicularly from a tangent to the tubular section 12. Preferably, the fin 14 has a uniform, generally trapezoidal cross-section, which slightly tapers towards the outer end 28. Two sides 26 of the fin 14 interface with the tubular section 12 in a smooth continuous fashion, each forming a concave surface. Alternative fin 14 designs, shapes and orientation can be used which promote slag adherence to the cooling pipe. For example, the fin 14 can project obtusely or acutely from the tangent to the tubular section 12. Additionally, the sides 26 and/or outer end 28 of the fin 14 can be provided with a rib. By rib it is intended to include a plurality of ribs, undulations, and crevices. Further, the fin 14 can be discontinuous, that is, formed of intermittent fin 14 segments, as shown in FIG. 5.

As shown in FIG. 3, the fin 14 and the base section 16 are oriented to be on opposite sides of a center-line 30 of the tubular section 12. Further, the size and position of the fin 14 and base section 16 are such that the mass on each side of the center-line 30 is equivalent. Hence, as the number of fins 14 are increased, either the base section 16 is enlarged or the cross-sectional area of the fins 14 is decreased. The cross-sectional area can be reduced by narrowing the fin 14 and/or reducing the distance the fin 14 extends from the tubular section 12.

In addition to mass balance, the cross-sectional shape, number, length and radial separation of the fins 14 are determined by slag retention and the heat transfer characteristics of the pipe 10 and cooling apparatus as a whole. Any number of fins 14 can be provided, such as from one to six, and preferably two. Moreover, the fin 14 can outwardly extend any length, preferably ¼ to four inches and, more preferably, about ⅝th inch. Further, the fins 14 can be spaced from each other by up to 120 degrees, and preferably about 45 degrees. FIG. 3 discloses the preferred embodiment of the pipe 10 with two fins 14 outwardly extending about ⅝ inch and the fins 14 spaced apart by approximately 45 degrees.

As shown by FIG. 1, a plurality of pipes 10 are connected to the panel 18. The pipes 10 parallel to each other and preferably arranged so that the base section 16 of each pipe 10 abuts the base section 16 of an adjacent pipe 10. The pipes 10 are connected in serpentine fashion, that is, an elbow (not shown) connects each pipe 10 to the succeeding pipe 10. The panel of pipes 10 can be arranged in a horizontal fashion or in a vertical fashion. Further, the pipes 10 can be linear, or, the pipes 10 can curve to follow the interior contour of the furnace wall 20.

The heat exchange pipe 10, including the tubular section 12, the fin 14, and the base section 16, is unitary and preferably produced by an extrusion process, however, other processes such as casting can be used. By unitary, it is meant that the pipe 10 (i.e. the tubular section 12, the fin 14 and the base section 16) is formed as one continuous apparatus as opposed to the separate parts which are joined, such as for example by welding, to form one apparatus. For extruding, the pipe 10 is formed of heavy-walled steel, iron, or ferrous material. Preferably, the mass on each side of the center-line of the tubular section 12 is equivalent so that stress risers are not created during the manufacture of the pipe 10. Since relatively uniform temperature in stress characteristics are maintained within the pipe 10 material during its manufacturer, the pipe 10 is less subject to damage caused by dramatic temperature changes encountered during the cycling of the electric arc furnace. For casting, the pipe 10 can be formed of a cast alloy such as, for example, cast iron or cast steel.

In operation, extruded heat exchange pipes 10 are attached to the panel 18. The panel 18 is hung within the electric arc furnace. Circulating fluid provided to the pipes 10 feeds through each pipe 10 in serpentine fashion. Slag splashing from the hearth of the furnace onto the pipes is retained by the surface of the pipes 10 and the fins 14. The slag, cooled by the pipes 10, freezes to the pipes 10 and forms an insulation barrier between the interior of the furnace and the pipes 10 and, consequently, the furnace wall 20. Upon failure of a pipe 10, the panel of pipes can be removed for repair and replaced by a new panel of pipes.

Although particular embodiments of the invention have been described in detail, it will be understood that the invention is not limited correspondingly in scope, but includes all changes and modifications coming within the spirit and terms of the claims appended hereto.

What is claimed is:

1. A heavy-walled steel, iron, cast alloy, or ferrous alloy pipe for use in a cooling panel in an electric-arc metallurgical furnace, comprising:

a unitary pipe, including:

a tubular section;

an elongate ridge extending outwardly from the exterior surface of said tubular section, said ridge extending along the length of the tubular section; and a base section on the exterior surface said tubular section, said base section opposed to said elongate ridge.

2. The heavy-walled pipe of claim 1, wherein said unitary pipe is formed by extrusion.

3. The heavy-walled pipe of claim 2, wherein said tubular section includes a first half having said ridge and a second half having said base, the mass of said first half being substantially equivalent to the mass of said second half.

4. The heavy-walled pipe of claim 2, wherein said unitary pipe is extruded from steel or an iron alloy material.

5. The heavy-walled pipe of claim 1, wherein said elongate ridge is a plurality of parallel elongate ridges.

6. The heavy-walled pipe of claim 5, wherein said elongate ridges extend radially from the exterior of said tubular section.

7. The heavy-walled pipe of claim 6, wherein said elongate ridges are spaced about 45 degrees apart.

8. The heavy-walled pipe of claim 5, wherein each said elongate ridge extends outwardly from said tubular section for about ¼ inch to about 4 inches.

9. The heavy-walled pipe of claim 8, wherein each said elongate ridge extends equidistantly from the exterior surface of said tubular section.

10. The heavy-walled pipe of claim 1, wherein said elongate ridge has a trapezoidal cross-section.

11. The heavy-walled pipe of claim 1, wherein said elongate ridge is discontinuous such that said ridge forms a segmented elongate ridge.

12. The heavy-walled pipe of claim 1, further including:

an electric-arc furnace;

a plate, said plate connected to said furnace; and said unitary pipe is a plurality of interconnected unitary pipes, said pipes are connected to said plate.

13. The heavy-walled pipe of claim 12, wherein said pipes are parallel and vertically oriented.

14. The heavy-walled pipe of claim 1, wherein said base section includes a planar surface facing away from said tubular section and opposed protruding ends.

15. The heavy-walled pipe of claim 14, wherein said protruding ends extend tangentially from said tubular section.

16. The heavy-walled pipe of claim 1, wherein said elongate ridge includes a rib.

17. A heavy-walled steel, iron, cast alloy, or ferrous alloy pipe for use in a cooling panel in an electric-arc metallurgical furnace, comprising:

a unitary pipe, including:

a tubular section having a first portion and a second portion;

means, outwardly extending from the exterior surface of said first portion of said tubular section, for retaining transient matter, said means forming an elongate ridge; and a base section on the exterior surface of said second portion of said main section, said base section opposed to said elongate ridge.

18. The heavy-walled pipe of claim 17, wherein said unitary pipe is extruded from steel or an iron alloy material; and said means comprises an elongate ridge.

19. A method of cooling the interior wall of an electric-arc furnace, comprising the steps of:

providing a panel, said panel including a plurality of unitary pipes, each of said pipes having a tubular section, an elongate ridge and a base section, each of said pipes being formed by extrusion;

attaching said panel to the interior of the electric-arc furnace; and retaining transient matter from the electric-arc furnace on said elongate ridge.

* * * * *